US006623084B1

(12) United States Patent
Wasyleczko

(10) Patent No.: US 6,623,084 B1
(45) Date of Patent: Sep. 23, 2003

(54) MOUNTING OF A ROTATABLE CHISEL IN MINING MACHINERY

(75) Inventor: Zenon Wasyleczko, Kowice (PL)

(73) Assignee: Boart Longyear GmbH & Co. KG, Burghaun (DE)

( * ) Notice: Subject to any disclaimer, the term of this patent is extended or adjusted under 35 U.S.C. 154(b) by 0 days.

(21) Appl. No.: 09/889,662

(22) PCT Filed: Jan. 14, 2000

(86) PCT No.: PCT/PL00/00006

§ 371 (c)(1),
(2), (4) Date: Sep. 19, 2001

(87) PCT Pub. No.: WO00/43636

PCT Pub. Date: Jul. 27, 2000

(30) Foreign Application Priority Data

Jan. 25, 1999 (PL) ..... 331059

(51) Int. Cl.[7] ..... E21C 35/197

(52) U.S. Cl. ..... 299/107; 299/104; 299/110; 403/344; 403/372

(58) Field of Search ..... 299/104, 106, 299/107, 110, 79.1; 411/513, 514; 403/373, 372, 374.1, 344, 289

(56) References Cited

U.S. PATENT DOCUMENTS

| | | | | | |
|---|---|---|---|---|---|
| 3,448,651 | A | * | 6/1969 | Passer | 411/42 |
| 3,707,752 | A | | 1/1973 | Brafford et al. | |
| 3,838,928 | A | * | 10/1974 | Blaurock et al. | 403/372 |
| 4,201,421 | A | * | 5/1980 | Den Besten et al. | 299/107 |
| 4,484,783 | A | | 11/1984 | Emmerich | |
| 4,603,911 | A | * | 8/1986 | Hindmarsh et al. | 299/104 |
| 4,743,069 | A | * | 5/1988 | Ojanen | 299/107 |
| 4,850,649 | A | * | 7/1989 | Beach et al. | 299/107 |
| 4,919,581 | A | * | 4/1990 | Dubech | 411/353 |
| 4,921,310 | A | * | 5/1990 | Hedlund et al. | 299/107 |
| 5,193,957 | A | * | 3/1993 | Fischer | 411/55 |
| 5,503,463 | A | * | 4/1996 | Ojanen | 299/107 |
| 2002/0074851 | A1 | * | 6/2002 | Montgomery, Jr. | 299/107 |

FOREIGN PATENT DOCUMENTS

| | | |
|---|---|---|
| DE | 2030322 | 2/1971 |
| DE | 2150991 | 5/1972 |
| DE | 7442380 | 4/1975 |
| DE | 8406019 | 5/1984 |
| DE | 4342341 | 10/1994 |
| EP | 0295232 | 12/1988 |

* cited by examiner

*Primary Examiner*—Heather Shackelford
*Assistant Examiner*—John Kreck
(74) *Attorney, Agent, or Firm*—Jordan and Hamburg LLP

(57) ABSTRACT

A chisel arrangement for mining machines includes a rotatable chisel including a working part, a supporting flange arranged adjacent to the working part, and a shaft arranged adjacent the supporting flange, the shaft having a lug and an end flange at an and opposite from the supporting flange. A chisel holder is arranged around apportion of the shaft, and a friction ring is arranged around the lug and at least partially against the chisel holder. The end flange of the shaft, a portion of the lug and a portion of the friction ring are arranged exterior of the chisel holder.

31 Claims, 4 Drawing Sheets

MOUNTING OF A ROTATABLE CHISEL IN MINING MACHINERY

BACKGROUND OF THE INVENTION

Figure 1:
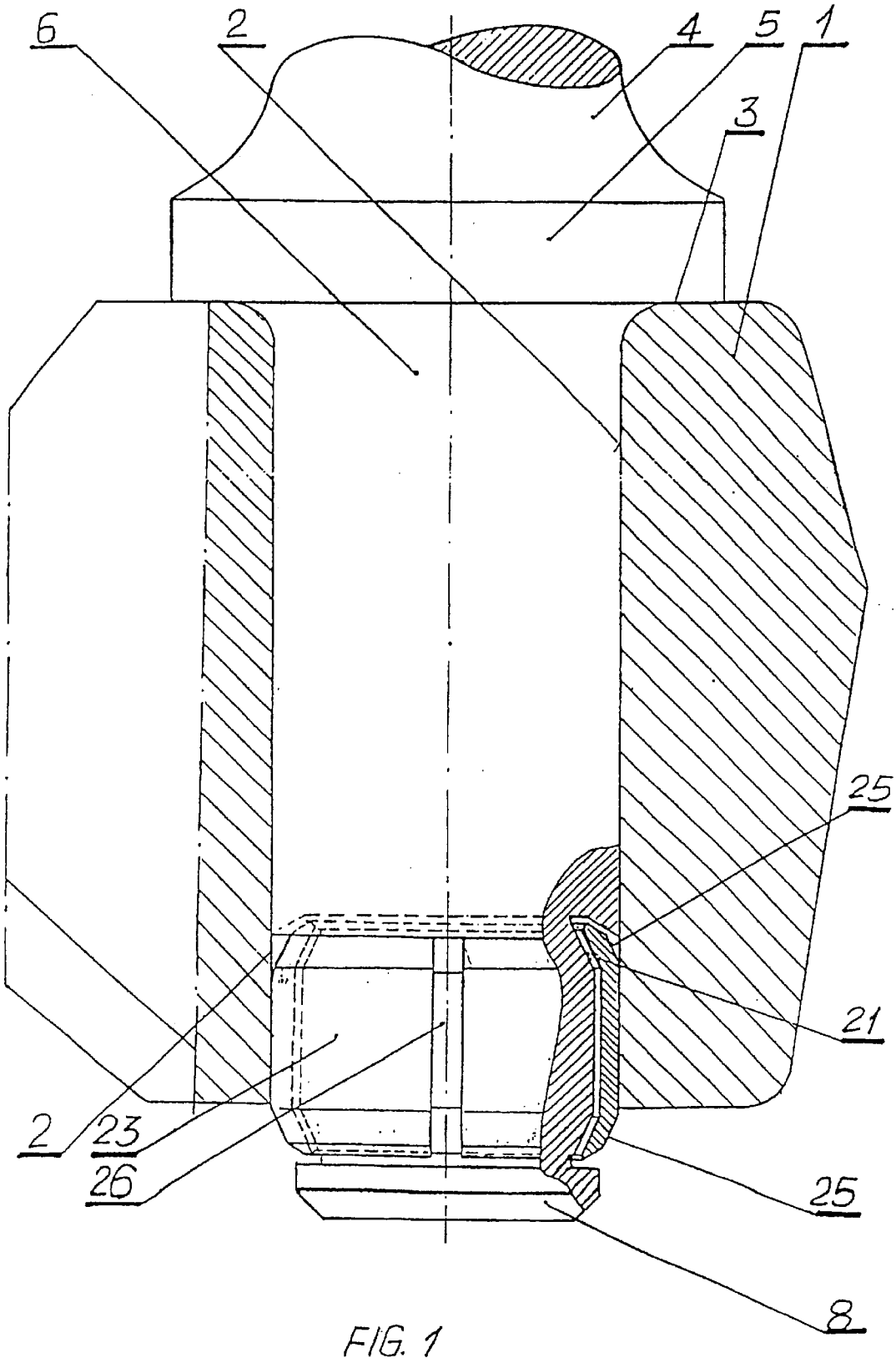

The invention relates to rotatable chisel especially for mining machines, which is used mostly in conveying and cutting heads of cutter roller loaders. The rotating chisel comprises a shaft and a working part with a flange for support at the front of a chisel holder. And the end of the shaft part of the rotating chisel, an elastic friction ring is disposed. The friction ring is slipped onto a section, constructed for this purpose, of the chisel shaft, which is provided with an end flange. The end flange and the part of the shaft, constructed for accommodating the friction ring, protrude together with the friction ring partly over the edge of the chisel holder, in which the chisel is fastened.

Many solutions for constructing chisel shafts are known from the state of the art and depend upon the safety mechanism employed. The Polish patent application 316, 848 discloses a chisel holder, which is widespread and has a wide flat groove in the vicinity of its end. When a chisel is inserted in the holder, an expansion sleeve, with surface elements constructed convexly at its surface, engages this groove and thus prevents the expulsion of the inserted chisel. In the case of this solution, the shaft of the chisel is completely in the chisel holder. It is a disadvantage of dissolution that the expansion sleeve, the so-called "clip ring", is relaxed after insertion in the chisel holder. A gap therefore remains between its inside and the surface of the groove and the small particles of the rock, which have been removed, collect in this gap. As a result, the free rotatability of the chisel holder, which is important for uniform wear, is made difficult after a certain time. Because of the intercalated small particles, it is also difficult, if not impossible, to compress the expansion sleeve and, with that, to exchange and a worn out chisel. A similar construction of the chisel shaft is shown in the British patent 2146058 and the U.S. Pat. No. 4,484,783.

Further solutions for structural shapes of shafts and components of the safety mechanism are unknown from the U.S. Pat. No. 4,684,176. In an example (there FIG. 1), the shaft is short and inserted completely into a hole of the chisel holder. A friction expansion sleeve, made from a thin metal sheet, is used over the whole surface of the shaft from the end flange to the supporting flange. Such sleeves are also known from the Polish patent 173,146 or, for example, from the German patent 3,233,123. These solutions have the disadvantage that the insertion of the chisel in the chisel holder is made difficult, since the sleeve, in the relaxed state, has a diameter larger than that of the internal hole of the chisel holder. As the chisel is driven in, the sleeve therefore shifts to the upper, cylindrical part of the shaft up to the flange and prevents further insertion of the chisel into the hole or, in the reverse case, a knocking out of the whole. The leads to difficulties in underground working conditions.

There are similar problems with the chisel, which is disclosed in the EP 0 295 232 A1 and the sleeve of which also is in contact with the shaft over almost its whole length and, at the bottom, is buckled and engages a groove, and, at the top, is angled to the outside. As a result, when the chisel is inserted into the seat of the chisel holder, the sleeve once again is expanded and is pushed upward, which can lead to jamming.

In a different embodiment of the already mentioned U.S. Pat. No. 4,684,176 (FIG. 3), there is a construction, for which the shaft of the chisel is longer than the hole of the chisel holder and protrudes from the latter. Normally, a narrow groove, into which a blockage in the form of a safety ring, a clamp or a splint is inserted, is assigned here to the end section of the shaft. Such solutions lead to difficulties, in as much as contamination collects between the shaft and the chisel holder hole and, due to friction wear, results in an ever increasing clearance at the inner hole. When the chisel holder hole has been expanded very much, the safety mechanism may also become ineffective, so that the chisel falls out of the chisel holder.

In a different U.S. Pat. No. 4,944,559, the groove is disposed at the shaft of the chisel, which protrudes from the hole of the chisel holder. In the case of this arrangement, there are sometimes even double safety mechanisms, predominantly in the form of two Seger rings or of one Seger ring and a locking barrier.

SUMMARY OF THE INVENTION

Starting out from this state of the art, it is an object of the invention to indicate a generic chisel and a safety mechanism preventing the chisel falling out during operation, which avoid the disadvantages of the previously known solutions, can be handled easily, have a simple structure and facilitate exchanging the chisel. The solution shall be usable equally for chisels, the shaft of which has a uniform diameter throughout its length, as well as for chisels, the shaft of which has a stepped diameter. The invention shall be suitable for fastening the chisel directly in the chisel holder as well as for fastening it in an intermediate sleeve.

Pursuant to the invention, this objective is accomplished owing to the fact that the end part of the chisel shaft is equipped with a projection, which is constructed as a lug and sloped to both sides, and that is, provided with chamfers. A friction ring, the diameter of which in the relaxed state is larger than the diameter of the hole of the chisel holder, is placed on the lug. At its upper and lower ends, the friction ring has inwardly inclined slopes, which are adapted to the chamfers of the lug. The chamfers of the lug and the slopes of the friction ring, inclined inwards on both side, cause of the friction ring to remain in the region of the lug during the insertion as well as during the expulsion of the chisel and prevent it from being pushed onto another part of the shaft. Because of this restricted guidance, there is no undesirable expansion of the friction ring. Moreover, in comparison with conventional shaft shapes with broad, smoothed accommodating grooves for a sleeve or a friction ring, the lug-shaped accommodating region of the shaft has the advantage for the friction ring that the lug does not represent an appreciable thinning of the material relative to the rest of the shaft and, in this respect, contributes, in addition to the rest of the shaft region, to the stabilization of the chisel during the rotation of the latter.

For the inventive solution, the effective fastening, as well as the easy, rapid and reliable handling during the fastening are of advantage. It also advantageous that a separate blocking piece does not have to be provided, since the friction ring is placed on the shaft of the chisel already by the manufacturer and is disposed of together with the worn out chisel. This construction of the safety mechanism for the chisel is not expensive and perhaps even less expensive than that of known safety mechanisms. Moreover, the inventive construction ensures and unimpeded rotation of the chisel in the chisel holder and, with that, a uniform wear. Since the lug is constructed as a simple extension of the shaft, the stability of the shaft, introduced into the chisel holder, is increased. The expansion of the chisel holder hole and the eventual breakage of the chisel, which are customary when chisels with short shafts are used, are avoided.

Further advantages of the invention arise out of the remaining dependent claims as well as from the following description of a preferred embodiment.

In the Drawings

Figure 2:
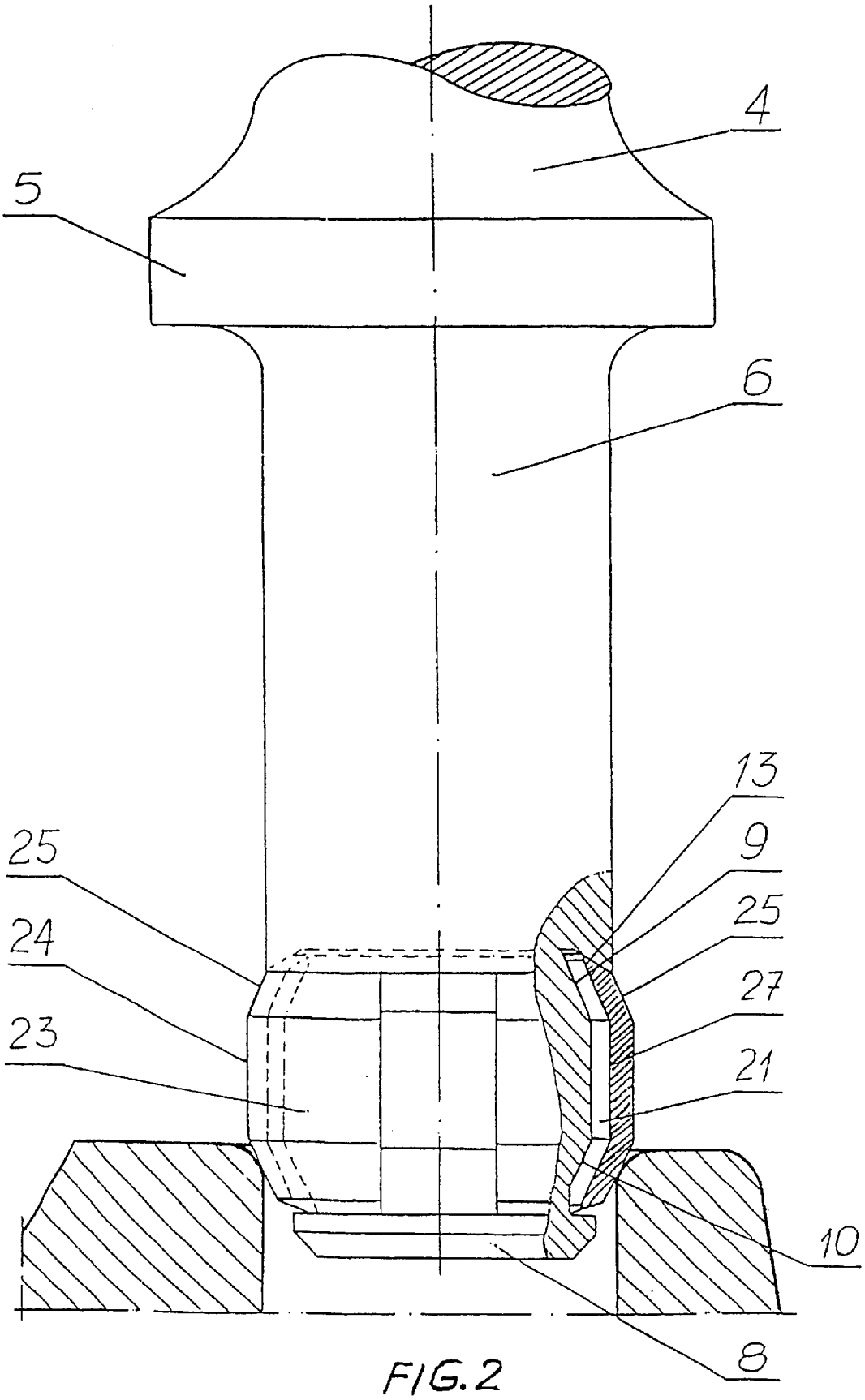
Figure 3:
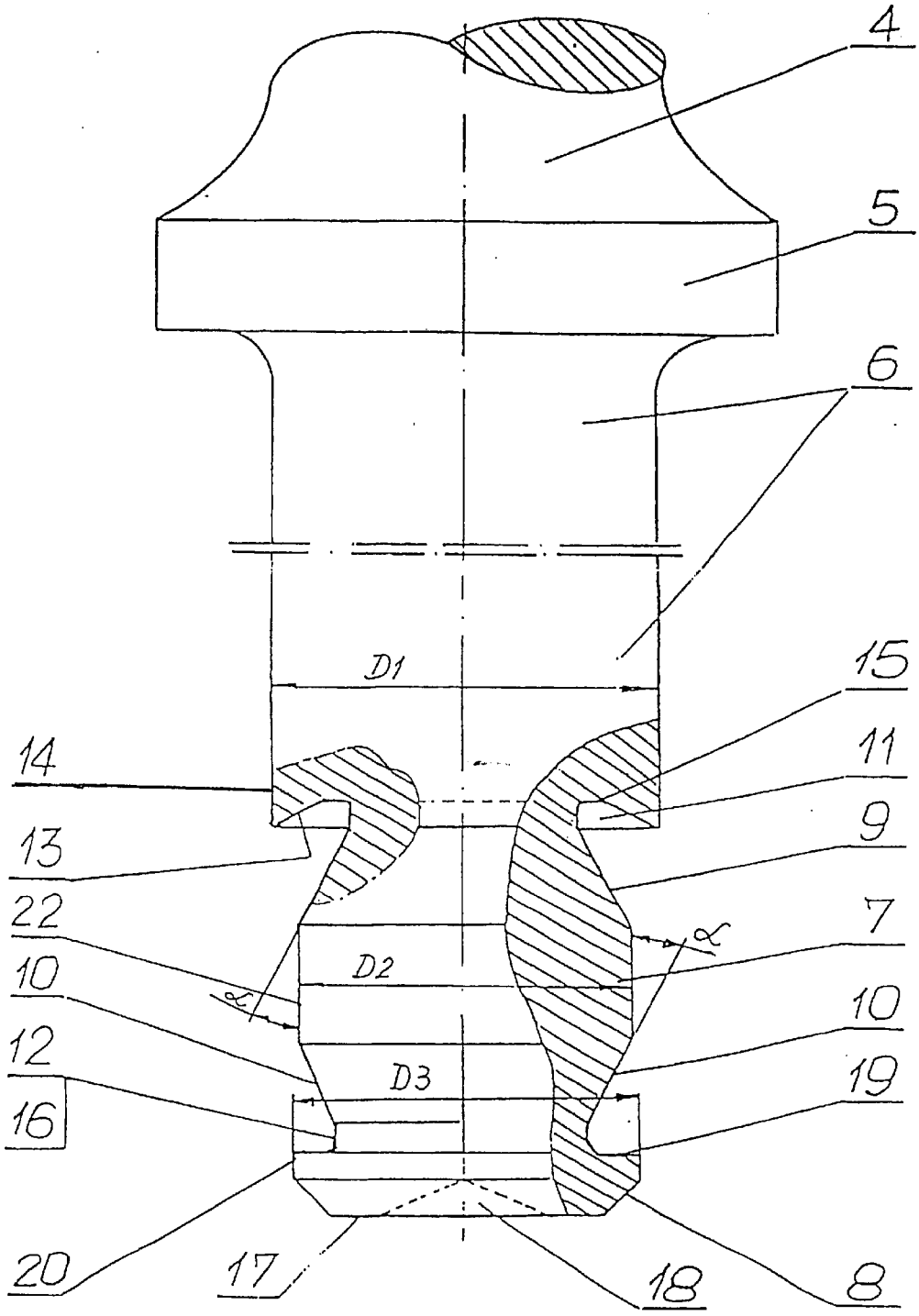
Figure 4:
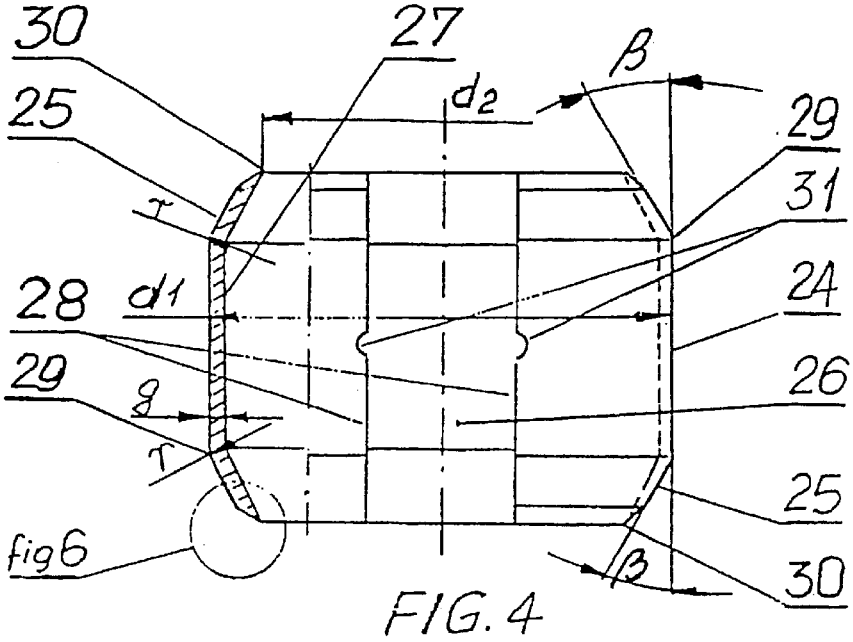
Figure 5:
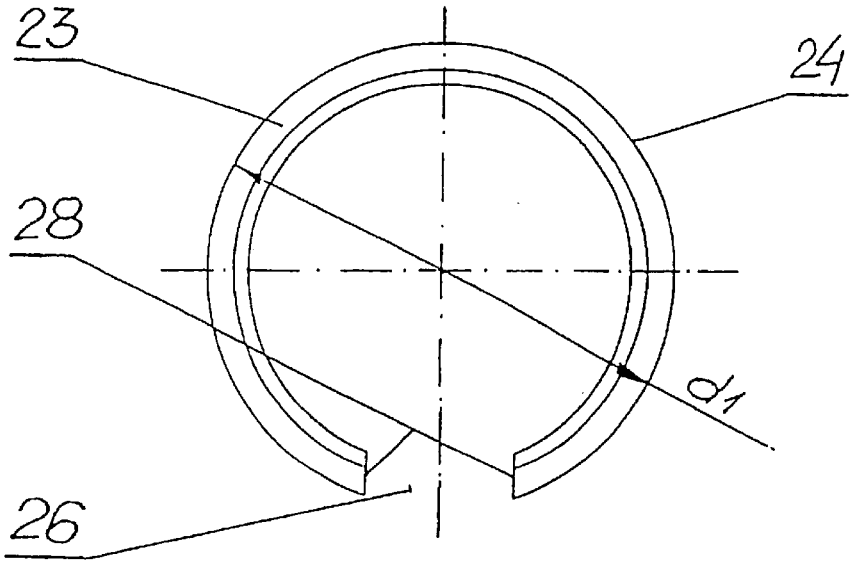
Figure 6:
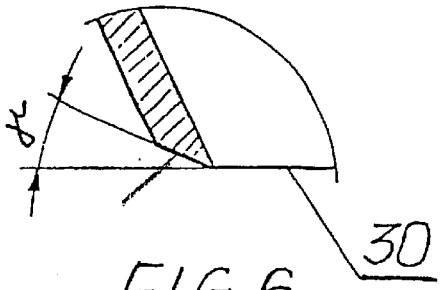

FIG. 1 shows a partial view of the rotating chisel with a uniform shaft and slipped-on friction ring, inserted in a chisel holder, which is shown in section, FIG. 2 shows a view of the rotating chisel shaft with slipped-on friction ring during the insertion into the chisel holder, partly in section FIG. 3 shows the shaft of the rotating chisel of FIGS. 1 and 2, partly in section, FIG. 4 shows a side view of the friction ring of FIG. 1 and 2 from the direction of the slot in the ring, partly in section, FIG. 5 shows a plan view of the friction ring, and FIG. 6 shows an enlargement of the chamfer of the end edge of the friction ring of FIG. 4.

DESCRIPTION OF THE PREFERRED EMBODIMENTS

Pursuant to the invention, the rotating chisel has a working part 4 and a mandrel-shaped shaft 6, which is connected with the working part 4 by a supporting flange 5. After the insertion of the rotating chisel in the chisel holder 1, the supporting flange 5 lies against the front 3 of the chisel holder 1. In its end section, the shaft 6 has a region, which is constructed as a lug 7 and is sloped to both sides and has a chamfer 9 to the side of the upper shaft part 6 and a chamfer 10 to the side of the end flange 8. Advisably, both chamfers 9, 10 are constructed identically and enclose between themselves and the peripheral surface 22 of the lug 7 an angle $\alpha$ of 10° to 35° and preferably of 25°. The diameter D2 of the lug 7 is smaller than the diameter D1 of the shaft 6 and the diameter D3 of the side surface 20 of the end flange 8. It is advantageous if the.diameter D3 of the end flange 8 is somewhat smaller than the diameter D1 of the shaft 6. Between the chamfer 9 and the inner inclined surface 13 of the shaft 6, a recess 11 is formed with a bottom 15 and with a straight or curved contour and, between the chamfer 10 and the inner side 19 of the end flange 8, a groove 12 with a bottom 16 with a straight contour is formed. A friction ring 23, which has slopes 25 to both sides and forms a slot 26 between two edges 28, is placed on the lug 7. Between themselves and the surface 20 for off the friction ring 23, the slopes 25 enclose an angle $\beta$, which is between 10° and 35° and preferably is 25°, so that the slopes 25 are aligned as far as possible according to the chamfers 9 and 10 of the lug 7. The diameter d1 of the friction ring 23, in the relaxed state, is larger than the diameter of the hole 2 of the chisel holder 1. However, the diameters d2 of the end edges 13 of the slopes 25 of the friction ring 23 are smaller than the diameter D1 of the shaft 6 and the diameter D3 of the side surface 20 of the end flange 8.

As a result, the end edges 30 of the slopes 25 of the friction ring 23 are disposed, on the one hand, in the recess and, on the other, in the groove 12. Consequently, the end edges 30 cannot be pushed out of the recess 11 and the groove 12 even in the relaxed state, not even when the friction ring 23 opposite the lug 7 is in its outermost end position. The diameters of the lug 7 and of the friction ring 23 and the diameter of the hole 2 of the chisel holder 1 are matched to one another in such a manner, that the friction ring 23, the wall of which has a thickness g, with its surface 20 exerts on the surface of the hole 2 a pressure, which is so large, that the frictional force prevents a displacement of the chisel 4 in the axial direction and the chisel 4 is reliably prevented from falling out of the chisel holder 1. Accordingly, the slot 26 is constructed so that its edges 28 cannot contact one another even when the friction ring 23 is stressed. At the same time, in order to assure free rotatability of the chisel 4 in the chisel holder 1, there is a gap 21 between the inside 27 of the friction ring 23 and the peripheral surface 22 of the lug 7. It is also important that only the surface 24 for of the friction ring 23 is in contact with the hole 2. For this reason, it is advantageous if the slopes 25 of the friction ring 23, from their transition 29 to the surface 24 up to the end edge 30 are shorter than the chamfers 9, 10 of the lug 7, so that the end edges 30 are not in contact, on the one hand, with the inner inclined surface 13 of the shaft 6 and, on the other, with the inside 19 of the end flange 8. The inner inclined surface 13 advisably extends at an angle of less than 90° (FIG. 3) towards the peripheral surface 14 of the upper shaft part 6, so that, when the chisel 4 is inserted in the chisel holder 1, the upper end edge 30 points in the direction of the bottom 15 of the recess 11. In addition, the end edges 30 are chamfered at an angle $\chi$ of about 15° to the outer side, in order to prevent the end edges 30 being pushed out of the recess 11 and the groove 12 even when there are larger manufacturing errors. In order to facilitate the insertion of the chisel 4 in the chisel holder 1, the transitions 29 between the surface 24 and the slopes 25 advisably have a radius r (FIG. 4), as a result of which the insertion of the chisel 4 can be accomplished even without a hammer by the exertion of a small force. This applies even in the case of friction rings 23, which have been hardened extensively by a heat treatment. In order to make it easier to slip the friction ring 23 onto the lug 7 and to take it off once again, the center parts of the edges 28 have recesses 31, which prevent pliers slipping off during a manipulation. In order to make it easier to drive out the chisel 4 especially in the case of heavy underground work, a small recess 18 is provided at the front side 17 of the end flange 8. This recess 18 prevents a tool slipping off from the front side 17, when blows are applied to it in order to drive the chisel 4 out of the chisel holder 1.

What is claimed is:

1. A rotating chisel assembly for insertion in a chisel holder, comprising:

a shaft and a working part with a flange, which acts as a support at a front of the chisel holder, when the shaft of the rotating chisel is inserted in an accommodating hole of the chisel holder;

the shaft having a lug provided with an end flange and an upper chamfer connecting to an upper shaft part of the shaft, and a lower chamfer connecting the end flange; and a friction ring disposed over the lug and having upper and lower slopes adapted to the upper and lower chamfers of the lug.

2. The rotating chisel assembly of claim 1, further comprising a recess formed in a transition from the upper chamfer of the lug to the upper shaft part and a groove formed in a transition from the lower chamfer of the lug to the end flange.

3. The rotating chisel assembly of claim 1, wherein a transition from the upper chamfer of the lug to the upper shaft part forms an undercut.

4. The rotating chisel assembly of claim 3, wherein the undercut is bounded by a an annular inner inclined surface defining an acute angle with respect to a peripheral surface of the upper shaft part.

5. The rotating chisel assembly of claim 4, wherein the friction ring concludes with upper and lower end edges at ends of the upper and lower slopes, wherein the upper and lower end edges are chamfered.

6. The rotating chisel assembly of claim 5, wherein the chamfer of the upper end edge of the upper slope of the friction ring is matched to the inner inclined surface of the undercut in the transition between the lug and the upper shaft part.

7. The rotating chisel assembly of claim 5, wherein a diameter of the lug is smaller by twice a thickness of the friction ring than a diameter of the upper shaft part.

8. The rotating chisel assembly of claim 1, wherein a diameter of the lug is smaller than a diameter of the upper shaft part.

9. The rotating chisel assembly of claim 1, wherein the upper and lower chamfers are inclined at an angle of 10° to 35° respectively with respect to a virtual cylindrical peripheral surface extending upward and downward from a cylindrical surface of the lug between the upper and lower chamfers.

10. The rotating chisel assembly of claim 1, wherein a diameter of the lug is smaller than a diameter of the end flange.

11. The rotating chisel assembly of claim 1, wherein an axial end surface of the end flange has a recess.

12. The rotating chisel assembly of claim 1 in combination with the chisel holder, wherein the end flange at the shaft of the rotating chisel protrudes out of the accommodating hole of the chisel holder when the rotating chisel is inserted in the chisel holder.

13. The rotating chisel assembly of claim 1, wherein the friction ring is a substantially tubular body having a slot in a longitudinal direction forming two mutually opposite friction ring edges.

14. The rotating chisel assembly of claim 13, wherein the friction ring edges have opposing recesses.

15. The rotating chisel assembly of claim 13, wherein the friction ring has a surface between the upper and the lower slopes and transitions between the surface and the upper and lower slopes are rounded.

16. A chisel arrangement for mining machines, comprising:

a rotatable chisel including a working part, a supporting flange arranged adjacent said working part, and a shaft arranged adjacent said supporting flange, said shaft having a lug and an end flange at an end opposite from said supporting flange;

a chisel holder arranged around a portion of said shaft; and a friction ring arranged around said lug and at least partially against said chisel holder;

said end flange of said shaft, a portion of said lug and a portion of said friction ring being arranged exterior of said chisel holder.

17. The arrangement of claim 16, wherein said shaft has substantially the same diameter as an inner diameter of said chisel holder, said friction ring having a thickness, said lug having a diameter smaller than a diameter of said shaft to accommodate twice the thickness of said friction ring between said lug and said chisel holder.

18. The arrangement of claim 16, wherein said shaft has a niche formed on a first side of said lug more proximate said supporting flange and a groove formed on a second side of said lug more proximate said end flange.

19. The arrangement of claim 18, wherein said shaft further includes a chamfer arranged between said lug and said niche, said shaft including an inwardly directed surface such that said niche is defined by said chamfer and said inwardly directed surface.

20. The arrangement of claim 18, wherein said shaft further includes a chamfer arranged between said lug and said groove, said end flange having an inner surface such that said groove is defined by said chamfer and said inner surface of said end flange.

21. The arrangement of claim 18, wherein said shaft further includes a first chamfer arranged between said lug and said niche, said shaft including an inwardly directed surface such that said niche is defined by said first chamfer and said inwardly directed surface, and a second chamfer arranged between said lug and said groove, said end flange having an inner surface such that said groove is defined by said second chamfer and said inner surface of said end flange, said first and second chamfers being oriented at the same angle relative to said lug.

22. The arrangement of claim 21, wherein said friction ring has end edges and a chamfer adjacent each of said end edge, one of said chamfers of said friction ring being arranged to extend into said niche and the other of said chamfers of said friction ring being arranged to extend into said groove to thereby restrain movement of said friction ring over said lug, said chamfers of said friction ring being inclined relative to a friction surface of said friction ring at the same angle as said chamfers of said shaft are oriented relative to said lug.

23. The arrangement of claim 18, wherein said friction ring has end edges and a chamfer adjacent each of said end edge, one of said chamfers being arranged to extend into said niche and the other of said chamfers being arranged to extend into said groove to thereby restrain movement of said friction ring over said lug.

24. The arrangement of claim 16, wherein said lug has a diameter smaller than a diameter of said end flange.

25. The arrangement of claim 16, wherein said end flange has a diameter smaller than a diameter of said shaft.

26. The arrangement of claim 16, wherein said end flange has a front end having an inwardly directed recess.

27. The arrangement of claim 16, wherein said friction ring includes end edges, a middle portion having a peripherally extending friction surface and chamfers arranged between said middle portion and said end edges.

28. The arrangement of claim 27, wherein said chamfers are inclined at an angle of from 10° to 35° to said friction surface.

29. The arrangement of claim 27, wherein each of said end edges is inclined at an angle of from 0° to 20° relative to a respective plane defined by a tip of said end edge.

30. The arrangement of claim 27, wherein said friction ring includes a gap defined by gap edges, each of said gap edges including a recess.

31. The arrangement of claim 27, wherein said friction ring includes said chamfers having curved chamfers adjoining said middle portion, said curved chamfers a same radius of curvature as one another.

* * * * *